US005099282A

United States Patent [19]

Tokuhara

[11] Patent Number: 5,099,282

[45] Date of Patent: Mar. 24, 1992

[54] VARIABLE MAGNIFICATION IMAGE FORMING APPARATUS

[75] Inventor: Mitsuhiro Tokuhara, Chigasaki, Japan

[73] Assignee: Canon Kabushiki Kaisha, Tokyo, Japan

[21] Appl. No.: 525,316

[22] Filed: May 21, 1990

Related U.S. Application Data

[63] Continuation of Ser. No. 271,337, Nov. 14, 1988, abandoned, which is a continuation of Ser. No. 93,153, Sep. 2, 1987, abandoned, which is a continuation of Ser. No. 794,315, Jan. 1, 1985, abandoned, which is a continuation of Ser. No. 482,415, Apr. 6, 1983, abandoned.

[30] Foreign Application Priority Data

Apr. 15, 1982 [JP] Japan ..... 67-62850

[51] Int. Cl.[5] ..... G03G 21/00

[52] U.S. Cl. ..... 355/218; 355/243; 355/55

[58] Field of Search ..... 355/218, 243, 55, 56, 355/35

[56] References Cited

U.S. PATENT DOCUMENTS

| | | | |
|---|---|---|---|
| 3,671,121 | 6/1972 | Albert | 355/3 ER X |
| 3,967,896 | 7/1976 | Looney et al. | 355/14 |
| 4,034,221 | 7/1977 | Yamashita | 250/324 |
| 4,318,597 | 3/1982 | Kotani et al. | 355/1 X |
| 4,344,691 | 8/1982 | Grant et al. | 355/1 |

OTHER PUBLICATIONS

Earle B. Brown, "Modern Optics", Reinhold Publishing Corporation, 1965, pp. 141-142.

*Primary Examiner*—R. L. Moses

*Attorney, Agent, or Firm*—Fitzpatrick, Cella, Harper & Scinto

[57] ABSTRACT

An image-forming apparatus capable of changing the size of the image formed on an electronic photosensitive medium is disclosed. The image-forming apparatus is provided with an auxiliary projection optical system in addition to a main projection optical system which is able to project an image on the photosensitive medium with variable magnification. The auxiliary projection optical system is provided to illuminate exclusively the non-image forming area of the photosensitive medium. The size of the image of the light source of the auxiliary projection optical system formed on the photosensitive medium is controllable as desired.

4 Claims, 3 Drawing Sheets

VARIABLE MAGNIFICATION IMAGE FORMING APPARATUS

This application is a continuation of application Ser. No. 271,337 filed Nov. 14, 1988, which is a continuation of Ser. No. 093,153 filed Sept. 2, 1987, which is a continuation of Ser. No. 794,315, filed Nov. 1, 1985, which is a continuation of Ser. No. 482,415, filed Apr. 6, 1983, all now abandoned.

BACKGROUND OF THE INVENTION

1. Field of the Invention

The present invention relates to an image-forming apparatus such as a variable magnification copying apparatus. More specifically, the present invention is directed to such an image-forming apparatus which is provided with an illumination mechanism for making the surface potential on the non-image forming area substantially equal to the surface potential on the bright portion of the image forming area of the photosensitive medium. For the purpose of this specification, "non-image forming area" means such area of the photosensitive medium which is not used to form an image thereon as a result of the change of image magnification. By the term "the bright portion of image forming area" is meant the portion of image forming area of the photosensitive medium which corresponds to the bright portion of the projected light image.

2. Description of the Prior Art

At present there are known and used various types of image-forming apparatus a representative example of which is a copying apparatus. In recent years variable magnification copying apparatus also have been proposed which are provided with the function to change the image magnification of the original image formed on the photosensitive medium.

In the known copying apparatus provided with variable magnification facility, when the image magnification is ×1 (one-to-one magnification) or more (copy making with enlargement), the whole surface of the photosensitive medium is usually used fully as the image forming area. However, when the image magnification is less than ×1 (copy making with magnification), a portion of the photosensitive medium remains unused as a non-image forming area. Since the non-image forming area is not subjected to the exposure of light corresponding to the image of the original, there is formed on the area a latent image equivalent to the dark portion of the original image. Therefore, at the step of developing a latent image formed by an image-wise exposure with charged colored developing particles such as toner to obtain a positive image of the original image, the latent image on the non-image forming area is also developed together with the development of the desired latent image on the image forming area. In other words, a large amount of toner is uselessly consumed to develop the non-image forming area. As a large amount of toner is consumed, the ratio of toner to carrier liquid or powder is rapidly reduced, and the degradation of the developing agent is accelerated even when the toner on the unnecessarily developed part is recovered for reuse. Furthermore, such a large amount of toner consumed by the non-image forming apparatus has an adverse effect on the cleaning device of the apparatus. As well-known to those skilled in the art, most image-forming apparatus of the type mentioned above are provided with a cleaning device to clean off the residual toner after transfer from the surface of the photosensitive medium. When the amount of toner used by the photosensitive medium is large, the wear of the cleaning device becomes larger.

A solution to the above problem hitherto widely used is to illuminate the non-image forming area by an auxiliary light source other than the light source for illuminating the original. To prevent the non-image forming area from being undesirably developed with toner, the surface potential on the non-image forming area is made to decay or erase by illuminating the area by an auxiliary light source. At the developing step, therefore, toner does not adhere to the non-image forming area. The transfer material can be separated from the photosensitive medium without being made dirty by toner. The problem of too rapid consumption of toner and degradation of the developer can be eliminated by this solution.

However, the above known solution involves some difficulties in designing the auxiliary light source for illuminating the non-image forming area. In a variable magnification copying apparatus, the size of the non-image forming area in a photosensitive medium is not constant but it is variable with the change of image magnification. The auxiliary light source is, therefore, required to be able to cope with the change in size of the non-image forming area.

In the apparatus disclosed in Japanese Patent Publication No. 24,862/1979, a plural number of illumination light sources are provided near the photosensitive drum. These light sources are individually switched on and off to illuminate the non-image forming area of the photosensitive drum. The number of the light sources to be lighted is decreased or increased suitably according to the size of the non-image forming area. A disadvantage of this known method is that it needs a plural number of light sources to illuminate the non-image forming area. Another disadvantage is found in that when the magnification is changed continuously, an optimum illumination can not always be u assured for the edge portion of the non-image forming area.

In another known apparatus as disclosed in U.S. Pat. No. 3,967,896, the non-image forming area is illuminated by a beam of light from a cylindrical lamp provided in the vicinity of the photosensitive drum. A movable shutter is provided near the cylindrical lamp to adjustably limit the area of the photosensitive medium to be illuminated by the beam of light.

Both of the above-mentioned prior art apparatuses have the following common difficulties:

Since the light source for illuminating the non-image forming area is located near the photosensitive medium and the illumination light is guided directly to the photosensitive medium from the light source, it is very difficult to illuminate exclusively the non-image forming area while defining a sharp boundary between image forming area and non-image forming area.

Secondly, since the space within which the light source is provided is near the photosensitive medium, the position in which the light source is provided is limited by it. It is required to mount the light source in such position as not to interfere with the optical path for projecting the original image on the photosensitive medium. Further, the location of the light source should not interfere with other members used for carrying out the image-forming process. Of course, these limitations makes it difficult to design the apparatus in a compact form.

Lastly, the light source is required to have sufficient length to cover the largest size of the non-image forming area. Because of it, the size of the light source part becomes inevitably large.

The above problems arise not only in copying apparatus but also in other image-forming apparatus in which the size of non-image forming area of the photosensitive medium is variable.

SUMMARY OF THE INVENTION

Accordingly it is an object of the invention to provide a variable magnification image-forming apparatus having an illumination mechanism which can sharply illuminate exclusively the non-image forming area of the photosensitive medium as produced by the change of image magnification.

It is another object of the invention to provide a variable magnification image-forming apparatus having an illumination mechanism for illuminating the non-image forming area of the photosensitive medium which illumination mechanism can change its illumination area continuously to cope with the change of the size of the non-image forming area to be illuminated by it.

It is a further object of the invention to provide a variable magnification image-forming apparatus having an illumination mechanism for illuminating the non-image forming area which is compact in composition and has no limitation as to its arrangement.

It is still a further object of the invention to provide a variable magnification image-forming apparatus having an illumination mechanism for illuminating the non-image forming area which can cope with the change in size of the non-image forming area and can illuminate it with always constant illuminance irrespective of the change in size of the non-image forming area.

To attain the objects the present invention provides a variable magnification image-forming apparatus provided with a novel illumination mechanism for illuminating the non-image forming area. In the case of, for example, a copying apparatus the novel illumination mechanism comprises an auxiliary light source H; different from the main light source of the image-forming apparatus, an auxiliary projection optical system different from the main projection optical system and means for controlling the illumination area of the light from the light source. In a copying machine, the main light source is a light source for illuminating an original, and the main projection optical system is that used to project an image of the original onto the photosensitive medium. The auxiliary light source and the auxiliary projection optical system in the non-image forming area illuminating mechanism are independent of these main light source and main projection optical system. A beam of light from the auxiliary light source is projected on the non-image forming area through the auxiliary projection optical system of the photosensitive medium. Said illumination area controlling means is disposed optically conjugated with the non-image forming area relative to the auxiliary projection optical system. With this arrangement, the non-image forming area can be illuminated while defining a sharp boundary between image forming area and non-image forming area on the photosensitive medium. In other words, the illumination mechanism according to the invention can sharply illuminate the boundary between image-forming area and non-image forming area.

The illumination area controlling means may be embodied in various manners. If the auxiliary light source can change its light emission area by itself, then it may be said that the auxiliary light source itself has the illumination area controlling means. In another embodiment, the illumination area control means is formed of a knife edge or other screen or shielding plate in a similar form provided in the optical path of the illumination light from the auxiliary light source. The knife edge or the like is moved in the direction intersecting the optical axis nearly at right angles to control the illumination area.

In the variable magnification image-forming apparatus, the mechanism for illuminating the non-image forming area is formed using a projection optical system as mentioned above. Therefore, according to the invention, it is possible to design the apparatus in such manner that the optical path of the illumination light for non-image forming area and the optical path of the illumination light for image forming area may be partly overlapped with each other. This makes it possible to realize a more compact composition of the apparatus. In the case where the non-image forming area is produced in the photosensitive medium, the optical path length from the original is generally reduced as compared with that in the case where the component of light orthogonal to the moving direction of the photosensitive medium is fully used. According to the invention, the portion of the optical path which is not used by the light coming from the original when the non-image forming area is produced, can advantageously be used as the optical path for the auxiliary illumination light to illuminate the non-image forming area.

Other and further objects, features and advantages of the present invention will appear more fully from the following description taken in connection with the accompanying drawings.

DETAILED DESCRIPTION OF THE PREFERRED EMBODIMENTS

Figure 1:
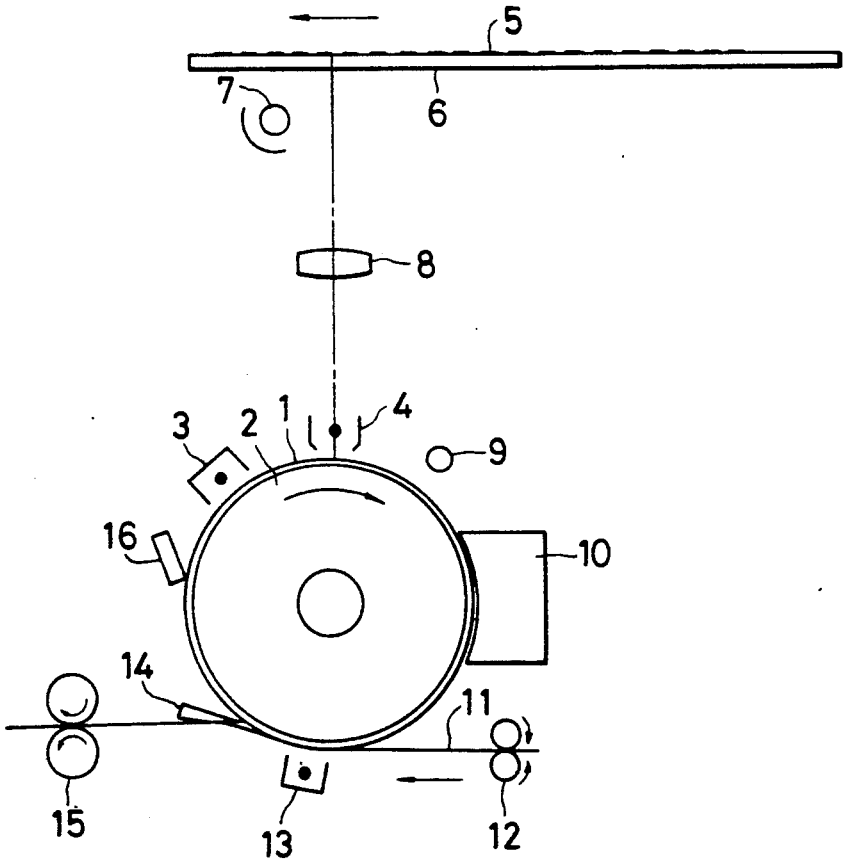
FIG. 1 is a schematic view illustrating an embodiment of the electrostatic latent image forming process applicable to the variable magnification copying apparatus as an example of the image-forming apparatus according to the invention.

In FIG. 1 is schematically shown a copying apparatus to which the present invention is applicable. In the copying apparatus electrostatic latent images are formed employing a known electrophotographic process as disclosed, for example, in Japanese Patent Publication Nos. 23,910/1967 and 24,748/1968.

The electrophotographic photosensitive medium 1 is of a conventional three-layer structure comprising an electrically conductive base layer, a photoconductive layer and a transparent insulating top layer piled in this order. The photosensitive medium 1 is laid on the circumferential surface of a drum 2 which is driven to rotate in the direction of arrow by a driving motor not shown. With the rotation of the photosensitive medium 1, its whole surface is at first uniformly charged by a corona discharger 3. At this primary charging step, therefore, the image forming area (the area of the photosensitive medium surface on which a latent image is formed which is later developed to a final visible image as a copy) and the non-image forming area are equally charged by the corona discharger 3. The polarity of charge with which the whole surface is uniformly charged by the corona discharger 3 is positive if the photoconductive layer is of N-type semiconductor and negative if it is of P-type. In any case, as the result of this primary charging, the photosensitive medium 1 becomes the state bearing electric charge thereon as described in the above-mentioned patent publications.

Following the primary charging, both of the image forming area and the non-image forming area are subjected to a secondary charging by AC or DC corona discharge from a corona discharger 4 whose discharge polarity is opposite to that of the above corona discharger 3. This secondary charging has an effect to uniformly remove off or render decayed the charge previously applied to the whole surface of the photosensitive medium 1 by the primary charger 3. Simultaneously with the secondary discharging, the image forming area of the photosensitive medium is exposed to a light image of an original 5. At the end of the step, therefore, in the image forming area of the photosensitive medium there are produced a particular charge bearing state and a particular distribution of surface potential which correspond to the image pattern of the original 5 as described in detail in the above-mentioned patent publications.

On the other hand, the non-image forming area of the photosensitive medium is not exposed to the light image of the original at the secondary charging step. Therefore, if light is not projected on this area simultaneously with the secondary charging by the corona discharger 4, then there will be produced in this non-image forming area substantially the same charge bearing state and the same surface potential as those at the portion of the image forming area which corresponds to the dark portion of the light image of the original.

In the conventional electrophotographic process, a whole surface exposure is carried out subsequently to the above secondary charging with simultaneous image-wise exposure. Thus, both of the image forming area and the non-image forming area are uniformly exposed to light by a supplementary projection optical system not shown. By this exposure, the surface potential on the portion of the image forming area which corresponds to the dark portion of the light image of the original is greatly changed. However, at the portion of the image forming area which corresponds to the bright portion of the light image the surface potential is little changed by the whole surface exposure. The surface potential at the portion corresponding to the bright portion of the light image remains substantially in the same state as that decayed by the previous step of the secondary charging with simultaneous image-wise exposure. Consequently, there is produced a high contrast between the surface potential at the dark portion and the surface potential at the bright portion of the photosensitive medium. However, since the non-image forming area is also subjected to the whole surface exposure, the surface potential in this area of the photosensitive medium is greatly changed at this step to the same degree as that in the portion of the image forming area corresponding to the dark portion of the light image. Consequently, the non-image forming area has substantially the same surface potential as the dark portion of the image forming area does, which has a high contrast to that of the bright portion of the image forming area. This means that at the next step of development, toner adheres also onto the non-image forming area of the photosensitive medium 1 whereby the non-image forming area is undesirably developed with the toner.

To eliminate the above disadvantage, according to the present invention there is provided an auxiliary illumination system as described later. The auxiliary illumination system illuminates the non-image forming area exclusively. The auxiliary illumination for the non-image forming area is carried out simultaneously with the above secondary charging by the corona discharger 4. The quantity of the auxiliary illumination light is so determined as to have an effect equivalent to the quantity of light of the bright portion of the light image projected on the image forming area. Thus, the non-image forming area is given substantially the same charge bearing state and the same surface potential as those at the portion of the image forming area corresponding to the bright portion of the light image of the original. Therefore, even after the next whole surface exposure by a lamp 9, the surface potential on the non-image forming area remains substantially unchanged in the state decayed by the secondary charging with simultaneous auxiliary illumination which is essentially the same state of the surface potential at the portion of the image forming area corresponding to the bright portion of the light image.

Referring again to FIG. 1, the original 5 is placed on an original carriage 6 and illuminated by an illumination lamp 7 to project by a lens 8 a light image of the illuminated original portion to the photosensitive medium 1 described above. To scan the original, the original carriage 6 is moved in the direction of the arrow in synchronism with the rotation of the drum. The corona discharger 4 has an optical slit through which the original image is slit-wise exposed onto the image forming area of the photosensitive medium 1.

After the uniform exposure by the lamp 9, an electrostatic latent image formed on the photosensitive medium 1 is developed by toner previously charged. The polarity of the charge on the toner is opposite to the polarity of the surface potential on the photosensitive medium at the portion corresponding to the dark portion of the light image. Thus, a visible positive image of the original 5 is formed by the development. 10 is a developing device used for this purpose. The developing device may be of wet type or dry type.

The developed toner image is then transferred onto a transfer paper 11. The transfer paper 11 is fed into the transfer station by a feeding device 12. At the transfer station, the transfer paper comes into contact with the photosensitive medium 1 and the toner image is transferred onto the transfer paper from the photosensitive medium with the aid of a corona discharger 13. The corona discharger 13 applied to the transfer paper corona discharge of opposite polarity to that of the toner from the backside of the paper to increase the transfer rate.

After transferring, the transfer paper is separated from the photosensitive medium 1 by separation means such as pawl and then advanced to a fixing device 15. On the other hand, the remaining toner on the photosensitive medium after transferring is removed off by a cleaning device 16. After cleaning, the photosensitive medium 1 can be reused for the next cycle of the above-described image processing.

Although an electrophotographic process using a three-layer photosensitive medium has been particularly shown and described with reference to FIG. 1 it is to be understood that the so-called Carlson process using a two-layer photosensitive medium also may be employed. The two-layer photosensitive medium comprises an electrically conductive layer and a photoconductive layer but does not have a top insulating layer. If this process is employed, the corona discharger 4 and the exposure lamp 9 shown in FIG. 1 are not necessary. In this case, the auxiliary illumination for the non-image forming area may be carried out at any position between the charger 3 and the developing device 10 with regard to the moving direction of the photosensitive medium. Even in the case shown in FIG. 1, it is not always necessary to carry out the auxiliary illumination simultaneously with the secondary charging by the corona discharger 4. The auxiliary illumination may be carried out prior to applying the corona discharge. After the auxiliary illumination and during the period in which the photoconductive layer is still in the state of reduced electric resistance by the auxiliary illumination, one can subject the photosensitive medium to the action of the corona discharger 4. Similarly, it is not always necessary to carry out the image-wise exposure simultaneously with the secondary charging by the corona discharger 4.

Figure 2A:
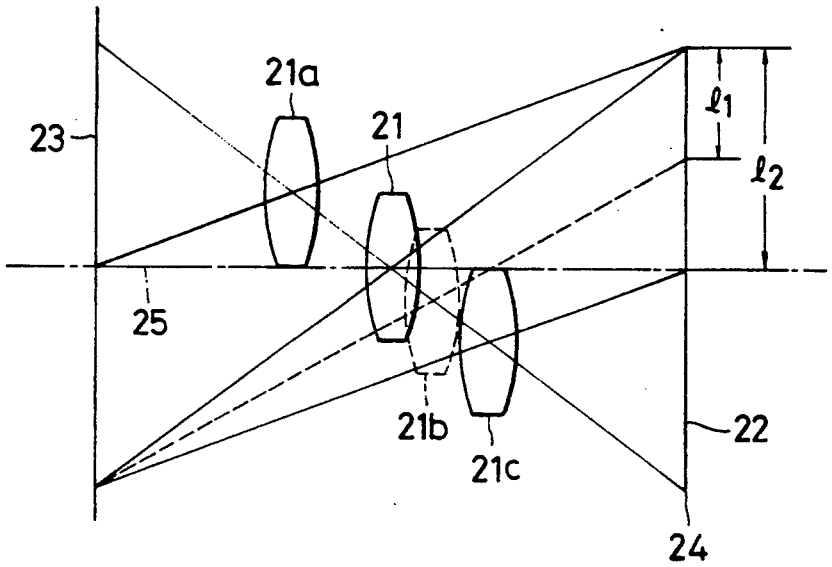
FIGS. 2A and 2B illustrate a variable magnification optical system used in the variable magnification copying apparatus as shown in FIG. 1.
Figure 2B:
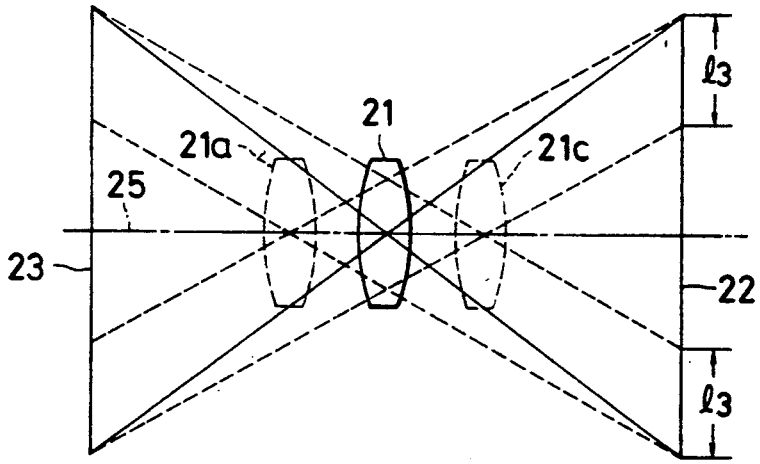

FIGS. 2A and 2B illustrate the relationship between the movement of the optical system and the size of non-image forming area in a variable magnification copying apparatus.

In FIG. 2A, 21 is a projection lens system, 22 is a photosensitive medium and 23 is an original. In the case shown in FIG. 2A, when the magnification of the image is changed, the optical system is moved in such manner that one edge portion 24 of the image of the original 23 can be projected always at the same position on the photosensitive medium. The projection lens system 21 is in the position for one-to-one magnification. Element 21*a* indicates the lens position for forming an enlarged image, and 21*b* and 21*c* indicate the lens positions for forming reduced images respectively. When the magnification is changed, the lens system 21 is moved in the direction orthogonal to the optical axis 25 thereby changing the distance between the lens system 21 and the original 23 as well as the distance between the lens system 21 and the photosensitive medium 22 while projecting one side edge of the original image always at the same position 24 so that the image varies in size in a direction (orthogonal to a direction) in which the photosensitive medium moves and along the photosensitive medium. If the lens system 21 is a zoom lens capable of changing the image magnification continuously, then it is possible to continuously change the magnification of the original image formed on the photosensitive medium 22 while maintaining the optical length from the original 23 to photosensitive medium 22 constant. If the projection lens system 21 is a single-focus lens, then it is necessary to change the optical length from the original 23 to the photosensitive medium 22 so as to correct it and to position the original 23 and the photosensitive medium 22 optically conjugated each other relative to the projection lens system 21.

When the projection lens 21 is in the position indicated by 21 or 21*a*, the width of the photosensitive medium 22 is fully used to form an image. Therefore, in this case, the photosensitive medium 22 does not have any non-image forming area. However, when the projection lens system is moved to the position indicated by 21*b* or to the position indicated by 21*c*, there is produced in the photosensitive medium such area not used to form an image, namely non-image forming area. When the projection lens system is in the position 21*b*, the area indicated by l1 is the non-image forming area varying in size in a direction (orthogonal to a direction) in which the photosensitive medium moves and along the photosensitive medium. When the projection lens system is in the position 21*c*, the area indicated by l2 is the non-image forming area extending in the predetermined direction in which the length of the image varies. If the projection lens system is a zoom lens capable of changing the image magnification continuously, then the size of the non-image forming area will be also continuously changed with zooming.

In the embodiment shown in FIG. 2B, the projection lens system 21 is moved only in the direction along the optical axis 25 and the position at which the edge portion of the image of the original 23 is projected on the photosensitive medium is not fixed. In this case, therefore, when the projection lens system is moved to a position for forming a reduced image of the original, for example, to the position indicated by 21*c*, non-image forming areas l3 varying in the orthogonal direction, are produced on both sides of the photosensitive medium 22. Even in this case, the formed image can be transferred on the transfer paper correctly in a determined area of the paper by suitably shifting the edge position of the transfer paper when it is fed to the photosensitive medium 22. The mechanism of the optical system for changing the image magnification in this embodiment corresponds to that of the FIG. 2A embodiment and need not be further described.

Figure 3A:
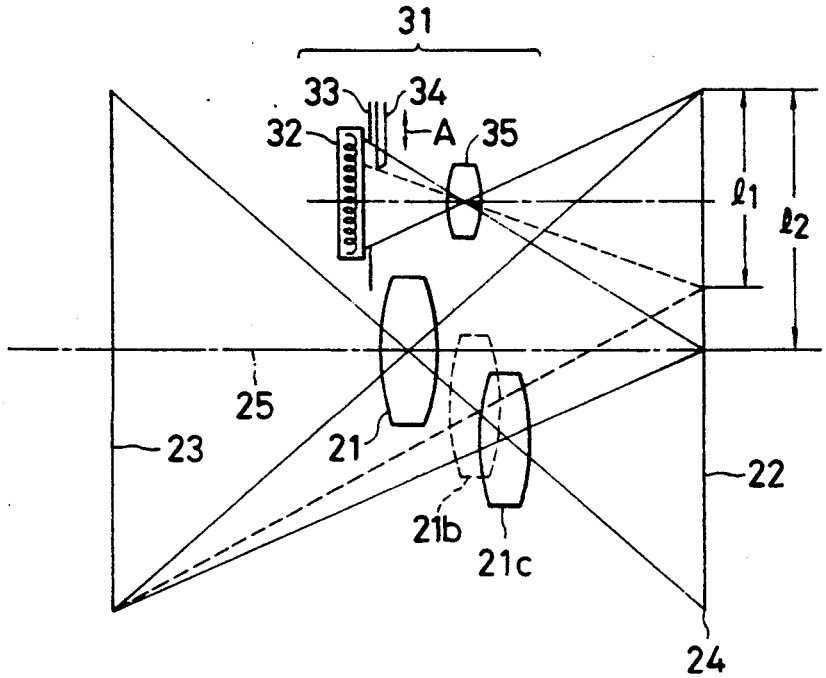
FIGS. 3A and 3B illustrate embodiments of the auxiliary illumination mechanism used in the apparatus according to the invention.
Figure 3B:
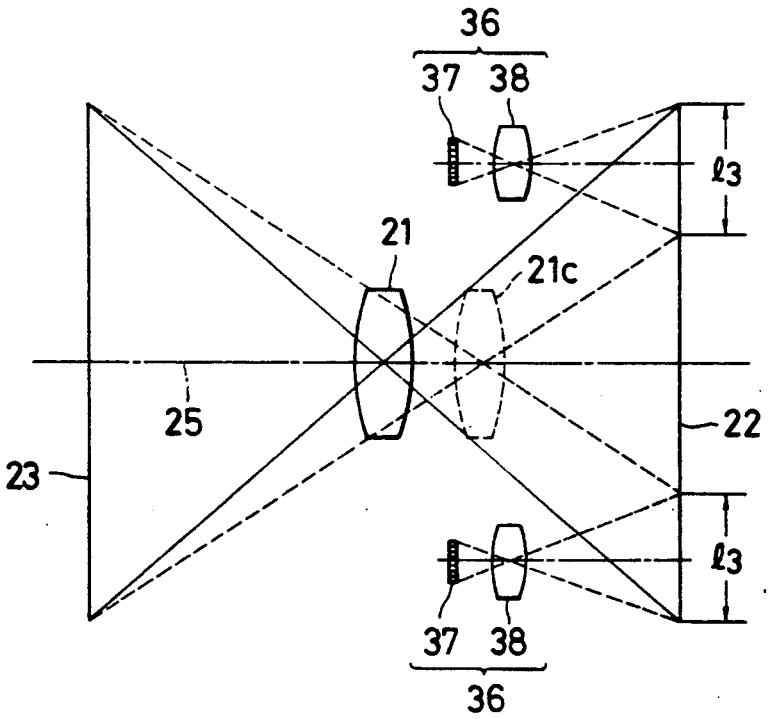

FIGS. 3A and 3B schematically illustrate the optical systems of a variable magnification copying apparatus in which the present invention has been embodied.

In FIG. 3A, the projection lens system (21, 21*b*, 21*c*), photosensitive drum 22, original 23, image edge portion 24, optical axis 25 and non-image forming area ($l_1$, $l_2$) entirely correspond to those shown in FIG. 2A and described above.

Designated by 31 is an auxiliary illumination mechanism for illuminating the non-image forming area for the purpose as described above, which constitutes an essential feature of the present invention.

The auxiliary illumination mechanism comprises an auxiliary illumination source 32 extending in the direction orthogonal to a direction in which the photosensitive medium moves and along the photosensitive medium, a slit 33, a knife edge 34 and an auxiliary projection lens system 35. The function of the slit 33 is to limit the beam of light coming from the light source 32. The knife edge 34 is located in the vicinity of the slit 33 and movable in the direction of the arrow A. The area of the opening of the slit 33 is changed by moving the knife edge 34 in the direction of the arrow A so that the opening of the slit varies in the orthogonal direction in which source 32 extends. The surface of the slit 33 and therefore also the surface of the knife edge 34 are disposed optically conjugated with the surface of the photosensitive medium 22 relative to the auxiliary projection lens system 35. With this arrangement, the beam of light exiting from the opening of the slit 33 serving as a secondary light source forms a light image on the photosensitive medium 22. The cross-sectional area of the beam to be projected on the photosensitive medium 22 can be changed in length at least in the orthogonal direction in which the source 32 extends by moving the knife edge for controlling the opening of the slit 33. Therefore, although the width of the non-image forming area changes with the change in position of the projection lens system 21, the auxiliary illumination mechanism 31 can illuminate exclusively the non-image forming area by suitably selecting the position of the knife edge 34. In FIG. 3A, the knife edge 34 is shown in the position for the non-image forming area l1 in the case where the projection lens system is in the position 21*b* for forming a reduced image of an original. In this manner, since the slit opening which can be regarded as a secondary light source, and the photosensitive medium are disposed optically conjugated with each other, the auxiliary illumination mechanism is able to illuminate sharply and exclusively the non-image forming area.

FIG. 3B shows another embodiment of the invention, the projection lens system (21, 21*c*), photosensitive medium 22, original 23, optical axis 25 and non-image forming area l3 entirely correspond to those in FIG. 2B, and 36 is an auxiliary illumination mechanism.

In this embodiment, the auxiliary illumination mechanism 36 comprises a light source 37 composed of solid light emitting element such as a light emitting diode array, and an auxiliary projection lens system 38. The light emission surface of the light source 37 and the surface of the photosensitive medium 22 are disposed optically conjugated with each other relative to the lens system 38. The individual segments of which the light source 37 is constituted are controllable independently of each other in emission of light. Therefore, the light emission area of the light source can be controlled as desired by controlling On-OFF of the segments individually. Thus, to cope with the change in size of the non-image forming area caused by the change in magnifying power of the projection lens system 21, the light emission area of the light source can be changed by suitably increasing or decreasing the number of segments from which light should be emitted. In this manner, like the embodiment shown in FIG. 3A, the auxiliary illumination mechanism shown in FIG. 3B also can illuminate the non-image forming area exclusively and sharply.

In the case of the optical system shown in FIG. B, the non-image forming areas are produced on both sides of the photosensitive medium by changing the magnification. Therefore, in this case, two sets of such auxiliary illumination mechanism 36 are needed.

As readily understood from the embodiments shown in FIGS. 3A and 3B, the auxiliary illumination mechanism according to the invention can form an image of the light source on the non-image forming area as an enlarged image. Consequently, a large non-image forming area can be illuminated by the auxiliary illumination mechanism using a small light source.

Furthermore, the auxiliary illumination mechanism does not need a particularly large additional space for its optical path. The optical path can be provided making use of a part of the space which is originally occupied by the optical path of the main exposure light used to project the image of the original on the photosensitive medium. This makes it possible to realize a compact structure of the apparatus.

Also, with the auxiliary illumination mechanism according to the invention, a uniform distribution of the illumination light on the non-image forming area is easily attainable by use of conventional means.

In the embodiment shown in FIG. 3A, the position of the knife edge 34 can be set mechanically in such manner that the knife edge may be moved in synchronism with the movement of the projection lens system 21 in a simple manner. On the other hand, in the embodiment shown in FIG. 3B, the control of the light emission area of the solid light emitting element 37 can be done easily by detecting the position of the projection lens system 21.

In summary, the variable magnification image-forming apparatus according to the present invention has the following advantages and remarkable effects:

The auxiliary illumination mechanism can illuminate sharply and exclusively the non-image forming area;

Even when the copy making is carried out while continuously changing the image magnification, it can correctly illuminate the non-image forming area while changing the illumination area to cope with the change in size of the non-image forming area;

There is no fear of leaking of the auxiliary illumination light into the image forming area;

It is possible to use only one light source for the auxiliary illumination;

A part of the optical path of the main exposure optical system can be used also for the auxiliary illumination mechanism, which is very advantageous for the arrangement of the apparatus; and Undesirable variation of illuminance can be eliminated and always uniform illumination can be assured.

While the present invention has been particularly shown and described in connection with a copying apparatus, it is to be understood that the present invention is equally applicable to other types of image-forming apparatus with the above-mentioned advantages and particular effects so long as any non-image forming portion is produced in the photosensitive medium as a result of the change of image magnification. For example, the present invention is applicable also to a laser printer which is also an image-forming apparatus using an electronic photosensitive medium.

What is claimed is:

1. An image-forming apparatus capable of changing the size of the image formed on a photosensitive medium, said apparatus comprising:

a main projection optical system capable of forming a first image of variable size on said photosensitive medium, said first image varying in size in at least a direction orthogonal to a direction in which the photosensitive medium moves and along the photosensitive medium;

a light source extending at least in substantially said orthogonal direction;

slit means having a variable-area opening, said opening varying in substantially said orthogonal direction; and an auxiliary projection lens system disposed such that said variable-area opening and said photosensitive medium are in an optically conjugate relation with respect to said auxiliary lens system for forming an enlarged image, focused at least in substantially said orthogonal direction, of a beam of light from said light source passing through said variable-area opening onto said photosensitive medium to illuminate exclusively a non-image forming area on said photosensitive medium, wherein said non-image forming area is defined by the size of said first image and is variable in size at least in said orthogonal direction with the change in size of said first image at least in said orthogonal direction.

2. An image-forming apparatus according to claim 1, wherein an optical path of said auxiliary projection lens system utilizes a part of a space occupied by the optical path of said main projection optical system.

3. An image-forming apparatus capable of changing the size of the image formed on a photosensitive medium, said apparatus comprising:

a main projection optical system capable of forming a first image of variable size on said photosensitive medium, said first image varying in size in at least a direction orthogonal to a direction in which the photosensitive medium moves and along the photosensitive medium;

a light source having a variable-area light emission means, said light source varying at least in substantially said orthogonal direction; and an auxiliary projection lens system disposed such that said variable-area light emission means and said photosensitive medium are in an optically conjugate relation with respect to said auxiliary projection lens system for forming an enlarged image, focused at least in said orthogonal direction, of a beam of light from said variable-area light emission means onto said photosensitive medium to illuminate exclusively a non-image forming area on said photosensitive medium, wherein said non-image area forming area is defined by the size of said first image and is variable in size at least in said orthogonal direction with the change in size of said first image at least in said orthogonal direction.

4. An image-forming apparatus according to claim 3, wherein an optical path of said auxiliary projection lens system utilizes a part of a space occupied by the optical path of said main projection optical system.

* * * * *

UNITED STATES PATENT AND TRADEMARK OFFICE

CERTIFICATE OF CORRECTION

PATENT NO. : 5,099,282

DATED : March 24, 1992

INVENTOR(S) : MITSUHIRO TOKUHARA

It is certified that error appears in the above-identified patent and that said Letters Patent is hereby corrected as shown below:

Title Page:

IN [63] RELATED U.S. APPLICATION DATA

"Jan. 1, 1985," should read --Nov. 1, 1985,--.

IN [30] FOREIGN APPLICATION PRIORITY DATA

"67-62850" should read --57-62850--.

COLUMN 6

Line 59, "applied" should read --applies--.

COLUMN 7

Line 64, "conjugated" should read --conjugated with--.

COLUMN 8

Line 13, "extending in the predeter-" should read --varying in size in a direction orthogonal to a direction in which the photosensitive member moves and along the photosensitive medium.--.

Line 14 should be deleted.

UNITED STATES PATENT AND TRADEMARK OFFICE

CERTIFICATE OF CORRECTION

PATENT NO. : 5,099,282

DATED : March 24, 1992

INVENTOR(S) : MITSUHIRO TOKUHARA

It is certified that error appears in the above-identified patent and that said Letters Patent is hereby corrected as shown below:

COLUMN 12

Line 11, "area" (first occurrence) should be deleted.

Signed and Sealed this

Twentieth Day of July, 1993

*Attest:*

Michael K. Kirk

MICHAEL K. KIRK

*Attesting Officer*

*Acting Commissioner of Patents and Trademarks*